United States Patent [19]

Becker et al.

[11] Patent Number: 4,777,771

[45] Date of Patent: Oct. 18, 1988

[54] GRINDING TOOL

[75] Inventors: Paul Becker; Manfred Brinkmann, both of Detmold, Fed. Rep. of Germany

[73] Assignee: Arminius Schleifmittel GmbH, Detmold, Fed. Rep. of Germany

[21] Appl. No.: 15,619

[22] Filed: Feb. 17, 1998

[30] Foreign Application Priority Data

Feb. 22, 1986 [DE] Fed. Rep. of Germany ..... 3605855

[51] Int. Cl.[4] ..... B24D 17/00

[52] U.S. Cl. ..... 51/363; 51/330

[58] Field of Search ..... 51/363, 358, 357, 330, 51/206.5, 206.4, 207; 125/11 CD, 34

[56] References Cited

U.S. PATENT DOCUMENTS

| | | | |
|---|---|---|---|
| 2,067,099 | 1/1978 | Kirchner | 51/357 |
| 2,851,830 | 9/1958 | Metzig | 51/206.4 |
| 3,347,219 | 10/1967 | Wellborn | 51/207 |
| 3,626,435 | 12/1971 | Toczak | 51/206.5 |

*Primary Examiner*—Frederick R. Schmidt
*Assistant Examiner*—Blynon Shideler
*Attorney, Agent, or Firm*—Laubscher & Laubscher

[57] ABSTRACT

A grinding tool has two bodies each provided with a row of grinding segments and arranged so that the bodies with the grinding segments are movable relative to one another; the grinding segments of one row are offset relative to the grinding segments of the other row so that upon movement of the base bodies relative to one another the rows of the grinding segments are insertable into each other at least over their partial length; the grinding segments are arranged on the supporting segments, the supporting segments are arranged on the grinding segment receivers, which in turn are arranged on the base bodies, and each of the supporting segments with the respective grinding segment carried thereby is releasably fixable in the respective grinding segment receiver in two respective mirror-inverted operative positions.

24 Claims, 9 Drawing Sheets

GRINDING TOOL

BACKGROUND OF THE INVENTION

The present invention relates to a grinding or sanding tool for profile strips of wood or the like, provided with grinding segments which have at least one grinding coating and correspond to the surface to be ground. More particularly, it relates to the grinding tool of the above type in which the grinding segments are fitted on a supporting segment which is formed to correspond to the surface to be ground, and at least the grinding segments are fixable on grinding segment receivers.

Profile strips of wood are known with different shapes of their cross-sections. Since they are mainly used for the interior construction, it is neccessary to grind at least their visible surfaces. The known tools which are identified in respective fields of application as grinding segment tools possess a disadvantage that for each profile respectively formed grinding and supporting segments are required. As a result of this, the manufacturer must permanently maintain a complete assortment of the tools. For the manufacturer of the tools it is also very disadvantageous that for producing the segments drawn from one synthetic plastic foil, respectively designed tools are required. With the known tools it is not possible, for example with the use of the same grinding segments, to grind the opposite rounded edges of two differently wide shaped strips, despite the fact that such contours have relatively simple cross-sections, such as rectangular cross-sections. For profile strips with irregular cross-sections and often wavy visible surfaces, it is possible to carry out grinding only by means of several successive working steps which involve corresponding cost increases.

SUMMARY OF THE INVENTION

Accordingly, it is an object of the present invention to provide a grinding tool of the above mentioned type which has a variable working width and is adjustable between a maximum working width and a minimum working width, preferably in a stepless manner, and in which the grinding segment receivers can be equipped with differently shaped grinding segments corresponding to the cross-section of the profile strips to be ground.

In keeping with these objects and with others which will become apparent hereinafter, one feature of the present invention resides, briefly stated, in a griding tool which has at least two rows of grinding segments, and two base bodies each associated with a respective one of the rows of the grinding segments, displaceable relative to one another and each provided with a row of grinding segment receivers, and in which the grinding segments of one grinding segment row are offset relative to the grinding segments of the other grinding segments row so that the grinding segment rows are insertable into one another over at least a part of their length. Each grinding segment is fitted on a supporting segment, the supporting segment is releasably mounted on the associated grinding segment receiver so that each supporting segment with the grinding segment fitted thereon is fixable in two opposite mirror-inverted operative positions on the respective grinding segment receiver. Since the grinding tool in accordance with the invention is provided with several grinding segment rows, the individual rows can be equipped with differently designed grinding segments. Thus it is possible in one working step to grind a radius on one edge and a groove on an opposite edge. Since each grinding segment row is associated with a displaceable base body, the same grinding segments can grind differently wide profile strips. Since the distance between two grinding segment receivers of one row is equal to or smaller than the width of one grinding segment receiver, regardless of the gaps of a relatively small width, a continuous surface is formed by the grinding coating and provides for an advantage in minimum dimensions and maximum grinding quality. The working width of the base bodies when they are completely inserted into one another is only a half or approximately a half of the working width of the base bodies when they are completely withdrawn from one another. The width of the grinding segment receiver is a value extending in the grinding direction, so that the length of the grinding segments determines the working width of the grinding tool. Since the grinding segments of one row are offset relative to the grinding segments of the other row, the possibility of insertion of the grinding segment rows in one another is provided in an extremely wide adjustment region. As a result of this, a very compact construction is obtained. In the grinding tool in accordance with the invention the number of the required grinding segments is considerably reduced, since the profile strips of different width and shape can be worked with the same segments. In accordance with an advantageous embodiment of the present invention, the base bodies have the same or approximately the same construction. This is very favorable for the manufacture and better exchangeability. It is especially advantageous when the base bodies and the grinding segment receivers are formed of one piece with each other. Thereby the number of the individual parts of the grinding tool is reduced. Furthermore, the means for connecting the base bodies with the grinding segment receivers and the required work are dispensed with. In the rotary grinding tool it is necessary to take measures for preventing loosening of the grinding segments under the action of centrifugal forces. Advantageously, the supporting segment is mounted on the grinding segment receiver. It is then especially advantageous when the supporting segment is composed of a shaped part or a profile strip, and a base profile segment which is mounted on it and corresponds to the contour of the surface to be ground. The base profile segment is composed of an elastic material, such as for example sponge-like rubber or cork. This base profile segment is then mounted on the shaped part or on the profile strip. The shaped part or the profile strip can be engaged by structural parts fixing the grinding segment. A simple and stable design of the base body is provided when it is formed as a disc, and when in the region of the outer edge several grinding segment receivers are arranged normal to the disc plane and at an equal angular distance from one another. This design of the base body is suitable only for the rotary grinding tool. In the one-piece construction of the base bodies and grinding segment receivers the parts describe the contour of a cylindrical basket which is open at the side opposite to the disc. The grinding segment receivers have for example a flat contour, and depending upon the design of the supporting segment the upper and/or lower side is curved in correspondence with the distance to the axis of rotation of the grinding tool. It is to be understood that in the above described embodiment the grinding segment receivers lie parallel and at the distance from the axis of rotation of the tool.

In the embodiment with the fixation of the grinding segments on the grinding segment receivers or in the embodiment with the one-piece grinding segment receivers and base bodies, the fixation on the base bodies is especially simple when each base body is associated with two clamping elements which engage the projections provided on the end surfaces of the grinding segment. The clamping segments can be formed as dogs or claws to provide a form-locking connection, so that in operation it is ensured that the grinding segments cannot be loosened under the action of centrifugal forces. Advantageously, the clamping elements are disc-shaped. The clamping elements associated with the outer edges of one base body are angled in direction to the end surfaces of the grinding segment and provided with recesses between the grinding segments. Because of the angled edges, the fixation is achieved in an especially simple manner, and the recesses ensure that the grinding segment rows are insertable into one another. This insertability is ensured in an especially simple manner when the clamping elements lie at both sides of the disc-shaped base bodies, and the inwardly located clamping element is basket-shaped so that in the region of the outer edge the webs normal to the disc plane are provided in correspondence with the number of the grinding segments receivers. The webs are arranged at equal angular distances relative to one another and lie under the grinding segment receivers of the respective base body. Since in this construction the webs of one basket-shaped clamping element are movable into the intermediate spaces formed by the webs of the other clamping element, the partially or fully inserted basket-shaped clamping elements describe a cylindrical contour. Instead of the rotary grinding tools, profile grinding belt units are also known in respective fields of application. In this embodiment the base body is advantageously formed as a flat belt with grinding segment receivers arranged on the outer side which faces away from the running surface. The grinding segment receivers project relative to a longitudinal edge of the belt advantageously by a distance which is equal to or smaller than the width of the grinding segment receivers. In this construction the grinding segment receivers of each base body can be provided with the grinding segments of different types. The working width of the profile grinding belt units is also variable, since the distance between the belts can be changeable.

The novel features of the present invention are set forth in the appended claims. The invention itself, however, will be best understood from the following description of preferred embodiments which is accompanied by the following drawings.

DESCRIPTION OF PREFERRED EMBODIMENTS

Figure 1:
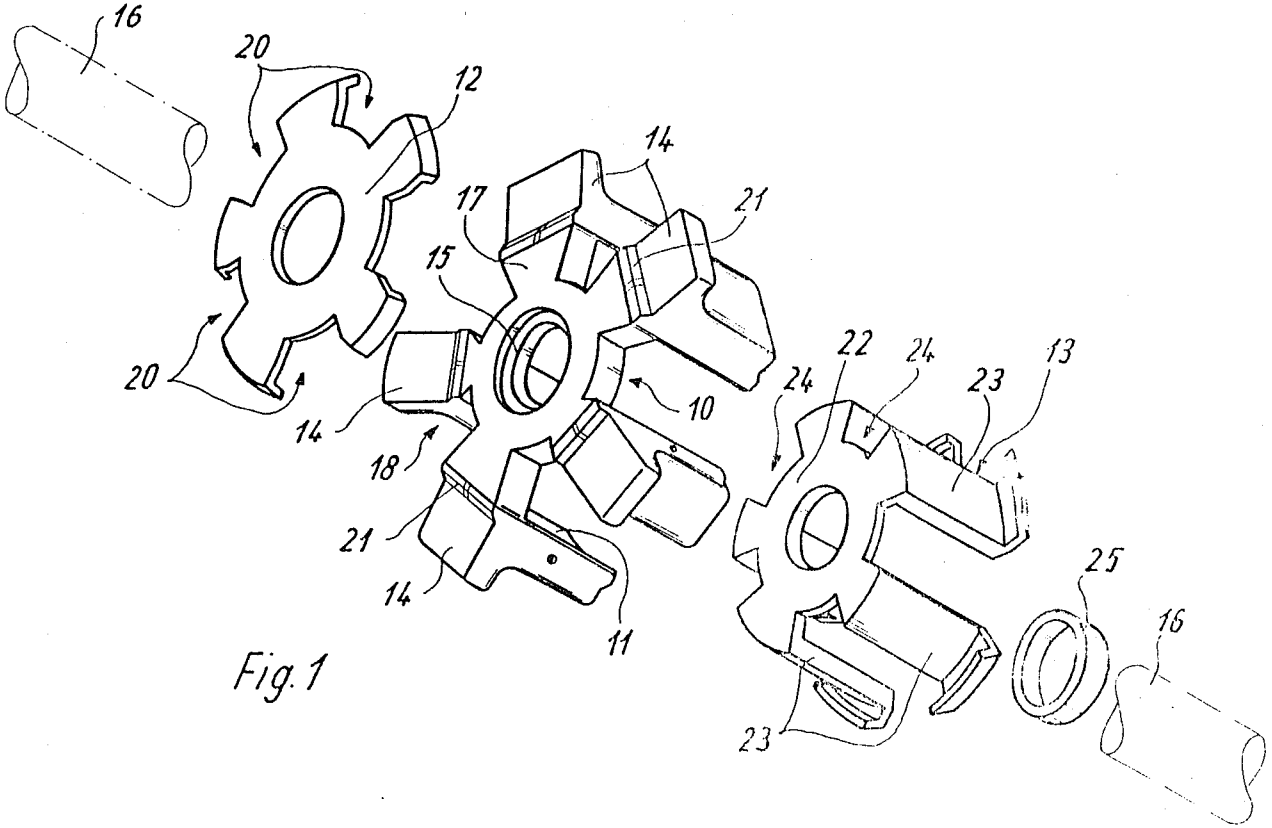
FIGS. 1 and 2 are exploded views of a rotary grinding tool in accordance with the present invention.

FIGS. 1–7 show a rotary grinding tool. It includes two base bodies 10 and 10*a*, grinding segments receivers 11 arranged on them, two disc-shaped clamping covers 12 and 12*a*, two clamping covers 13 and 13*a* formed as baskets, and grinding segments 14 fixed on the grinding segment receivers 11. The base body 10, 10*a* is composed of a disc 17 and 17*a* which is provided with an opening 15 for passing a grinding spindle 16 therethrough, which is shown in broken lines. The edge regions of the discs 17 and 17*a* in the present embodiment are provided with five recesses 18, 18*a*. The base bodies 10, 10*a* are formed as a multiple wedges, and the edges which limit the recesses 18 intersect in the axis of rotation of the grinding tool.

The grinding segment receivers 11 are arranged on the free edges of the base body 10,10*a* normal to the discs 17*a*, 17. In this embodiment the base bodies 10,10*a* and the grinding segment receivers 11 are formed of one piece with one another and composed of metal, for example aluminum. The grinding segment receivers 11 have a rectangular cross-section, but their faces which face one another are curved. The cross-section of the grinding segment receivers 11 corresponds to the shape and type of the mounting of the supporting segments 19, which support the grinding segments 14, as shown in FIG. 5. In FIGS. 1–4 these supporting segments are not visible, since the grinding segments are fitted on them. As can also be seen from FIGS. 1 and 2, the grinding segment receivers lie axially-parallel to the axis of rotation.

The clamping covers 12, 12*a* are also provided in their edge regions with five recesses 20 and 20*a*. In the inserted position the webs formed between the recesses 18, 18*a* and 20, 20*a* coincide with one another. The outer edge of the web formed by the recesses 20,20*a* is angled in a direction to the associated base body. Thereby a holding face extending along the same angle is engaged, the holding face abutting against the end face of the grinding segment 14. The basket-shaped clamping covers 13, 13*a* are similar to the parts formed from the base bodies and the grinding segment receivers, as clearly shown in FIGS. 1 and 2. Therefore they are composed of discs 22, 22*a* and rectangular webs 23 and 23*a* extending from the edge region. The discs 22, 22*a* are provided with recesses 24, 24*a*. In the inserted position the recesses 18, 18*a*, 20,20*a*, 24, 24*a* are in alignment with each other. The webs 23 lie at such a distance from the axis of rotation that the lower side of the grinding segment receivers 11 and the upper side of the webs 23 or 23*a* abut against one another. The free ends of the webs 23 and 23*a* are formed as claws or dogs by means of double bending in a direction to the disc 22 and 22*a*. Thereby the holding faces 21 of the grinding segments 14 can be engaged.

Figure 2:
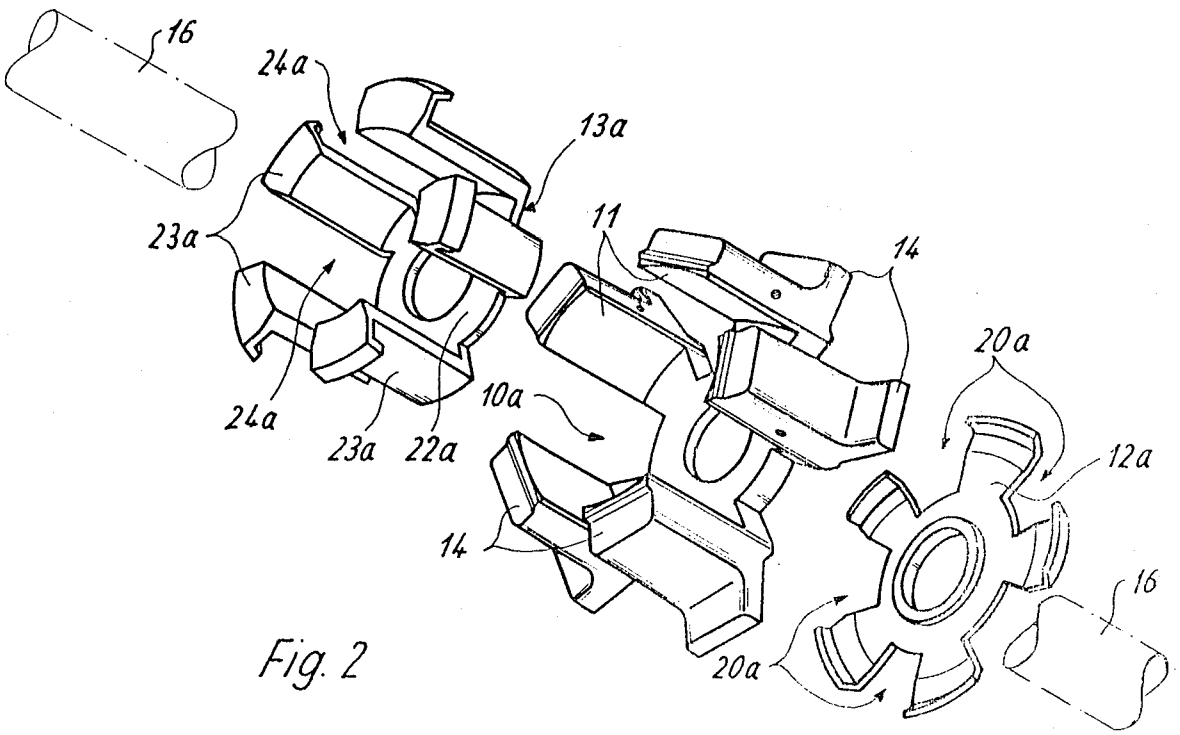
Figure 4:
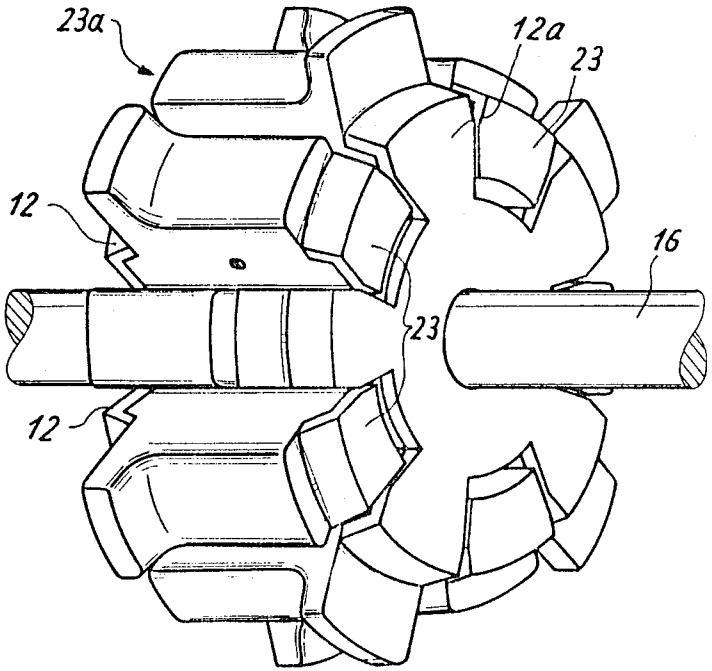
FIGS. 3 and 4 are views showing the grinding tool of FIGS. 1 and 2 for two different profile strips with a minimum working width, in perspective.
Figure 3:
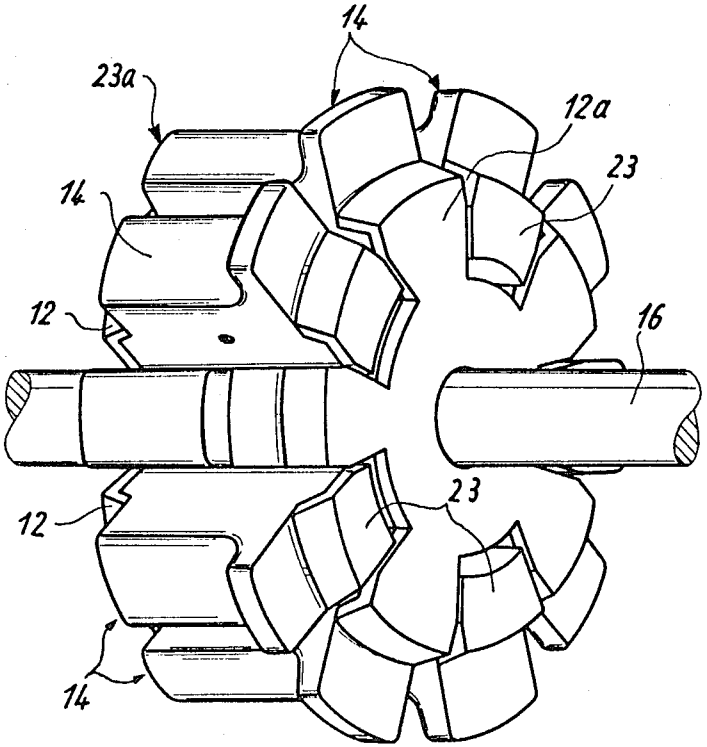
Figure 5:
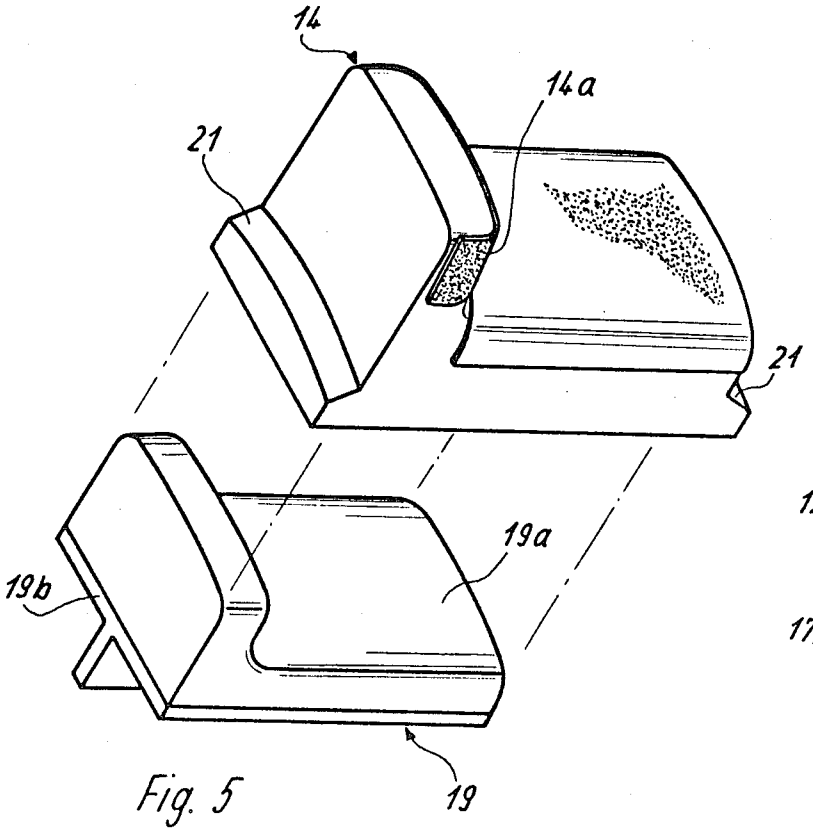
FIG. 5 is a view showing a part of the grinding tool shown in FIGS. 1 and 2.

FIGS. 3 and 4 show the rotary grinding tool of FIGS. 1 and 2 in assembled position. It can be seen from both figures that each grinding segment 14 is held by the clamping cover 12 or 12*a* and by the web 23 or 23*a*. Furthermore, it can be seen that the grinding segments 14 of the base bodies 10, 10*a* which form one grinding segment row are arranged alternately with these base bodies. In the shown embodiment the grinding segment row includes ten grinding segments, since each base body has five grinding segments. The number of the grinding segments can, of course, be changed. It is especially advantageous in accordance with the present invention that the base body 10 with the attached grinding segments and the clamping covers 12 and 13 can be assembled into a structural unit. The base body 10*a* with the attached grinding segments and the clamping covers 12*a* and 13*a* can also be assembled into a structural unit. Then these two structural units can be inserted into one another as shown in FIGS. 3 and 4. As can be seen from the drawings, the grinding segments 14 are provided for grinding a strip with a radius. This radius in the embodiment of FIG. 3 is ground only on one edge, since the upright parts of the grinding segments are in alignment with each other. In the embodiment of FIG. 4 each second grinding segment of the grinding segment row is offset by 180° relative to the other grinding segments. Thereby there exists a possibility to grind a strip with radii provided on two opposite edges. For adjusting the tool to the respective width of the strips to be ground, the above mentioned structural units can be more or less inserted into one another. For firmly fixing the individual structural units to one another, a spacer ring 25 designed in correspondence with the respective width of the strips is provided. The spacer ring 25 is inserted between the mutually facing faces of the discs 22, 22*a* of the basket-shaped clamping covers 13 and 13*a*.

FIG. 5 shows that the grinding segment 14 is supported on the above-mentioned supporting segment 19. The grinding segment 14 is, as shown, fitted over the supporting segment 19. In the embodiment of FIG. 5 the supporting segment 19 includes a base profile segment 19*a* which corresponds to the surface to be ground and is composed of an elastic material, such as sponge-like rubber or cork. It also includes a T-shaped strip 19*b*. In contrast to the embodiment of FIG. 5, instead of the strip 19*b*, a shaped part composed of a foil can be provided. This latter embodiment provides an advantage resulting in a cost-effective manufacture and a simple mounting on the grinding segment receivers. The grinding segment 14 has a grinding coating 14*a* on its working surfaces. The segment 14 is also produced by deep drawing from a foil.

Figure 6:
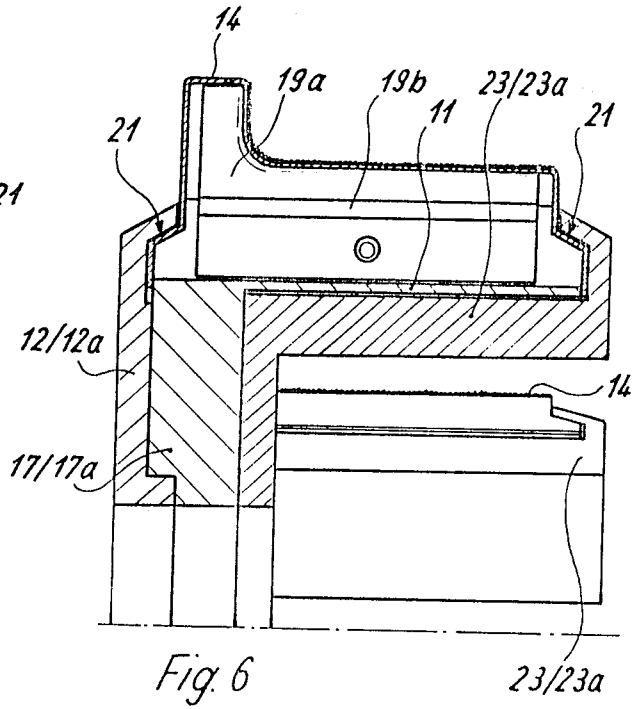
FIG. 6 is a view showing a section of the grinding tool corresponding to FIGS. 3 and 4.
Figure 7:
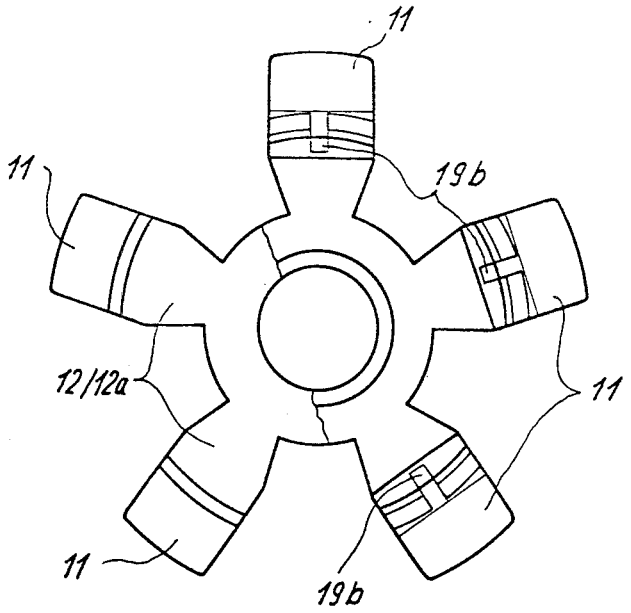
FIG. 7 is a plan view of a part of the grinding tool in correspondence with FIGS. 1–4.

FIG. 6 specifically shows the fixation of the supporting segment 19 and the grinding segment 14. Each grinding segment is provided with a longitudinal slot extending in the direction of the axis of rotation. A radially extending web of the T-shaped profile strip 19*b* engages in the longitudinal slot. Each supporting segment is secured by means of a threaded pin which is screwed into a threaded opening of each grinding segment receiver. FIG. 7 shows an end view of the structural unit assembled from the parts shown in FIGS. 1 and 2, wherein the end clamping covers 12 and 12*a* are shown only partially. It can be seen that the grinding segment receiver is provided with the above mentioned slot for receiving the profiled strip 19*b* of the supporting segment 19. The grinding segments 11 are arranged in correspondence with FIG. 3.

Figures 8, 9, 10:
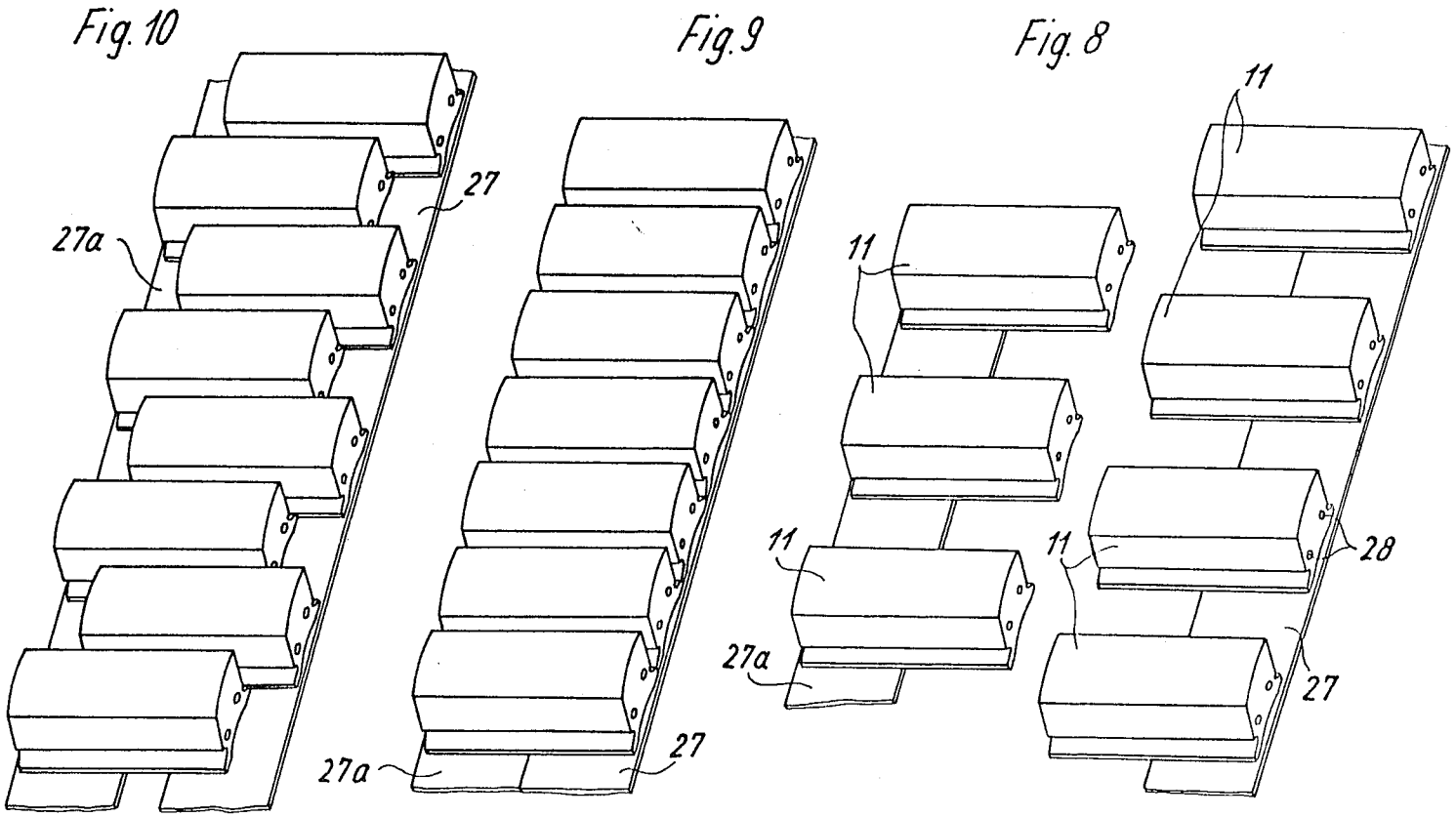
FIGS. 8–10 are views of the inventive grinding tool which is formed as a profile grinding belt unit, in perspective.
Figure 12:
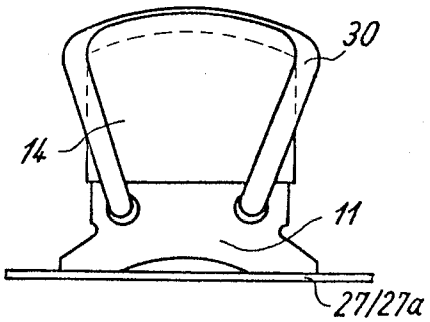
FIG. 12 is an end view of the tool shown in FIG. 11.

FIGS. 8–12 show an embodiment in which the grinding segment receivers 11 are mounted on two flat belts 27 and 27*a*. As can be seen particularly from FIG. 8, the length of each grinding segment receiver is double the width of the belt. Since the distance between two grinding segment receivers 11 is double the width or somewhat greater than the width of each grinding segment receiver, these can be inserted into one another so that the end faces lie in alignment with each other as shown in FIG. 9. In FIG. 10 the flat belts 27 and 27*a* are located at a distance from one another. It can be seen from this that with the fitted grinding segments the grinding width can be increased, however only to such an extent that the grinding segment receivers still engage in one another.

In the embodiment of FIGS. 8–10 the length of the grinding segment receivers 11 is double the width of the belt. It is to be understood that this ratio can be changed. In this embodiment the grinding segment is formed as a block and is composed of rubber. Each grinding segment receiver 11 is provided in its lower region with two openings 28, which extend parallel to one another and transverse to the longitudinal edges of the belts 27 and 27*a*.

Figure 11:
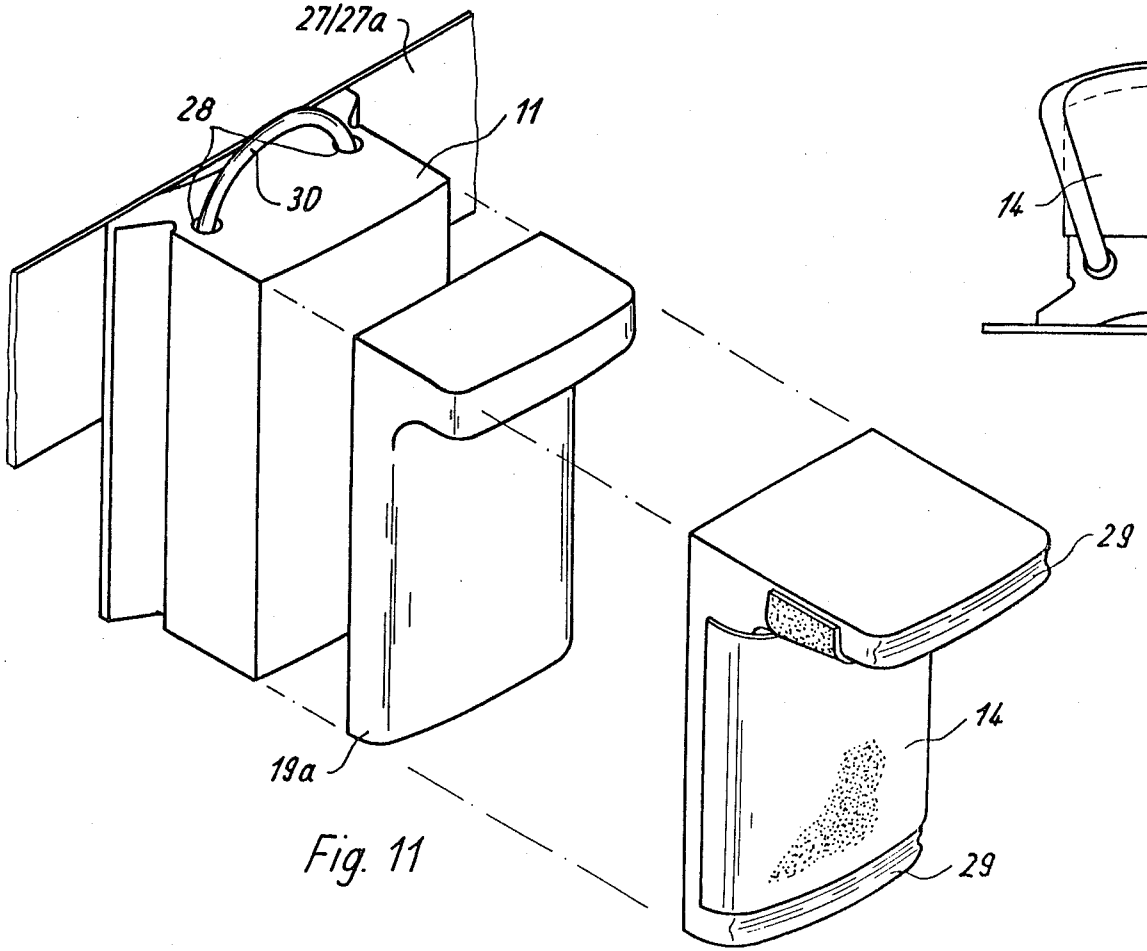
FIG. 11 is a partial view of a profile grinding belt unit in accordance with FIGS. 8–10, in an exploded manner.

FIG. 11 shows that the grinding segment 14 is also mounted on the respective grinding segment receiver with the use of a base profile segment 19*a*. In the region of the end sides the grinding segment is provided with depressions which extend in the grinding direction. For fixation, an elastic band 30 is passed through the openings 28. The length of the elastic band is such that it can be pulled upwardly on the end sides of the grinding segment 11 and lie in the depressions 29. The ends of the band 30 are connected with one another in a non-illustrated manner, or fixed on the grinding segment. For simplifying replacement, instead of the above described openings 28, the grinding segment receivers can be provided with slots which are open in the direction to the belts 27 and 27*a*. When the grinding segment receiver is curved on the side facing the belts, an endless band can be placed in this slot. Further possibilities of mounting are also conceivable.

The flat, belts 27, 27*a* can be provided in a non-illustrated manner with a profiled running surface. Especially advantageous are trapezoidal tunnels extending transverse to the running direction.

Figure 13:
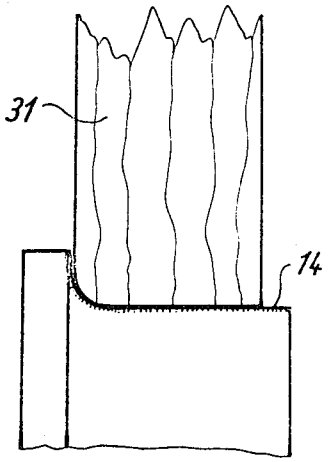
FIGS. 13–20 are views showing various applications of the inventive grinding tool.
Figure 14:
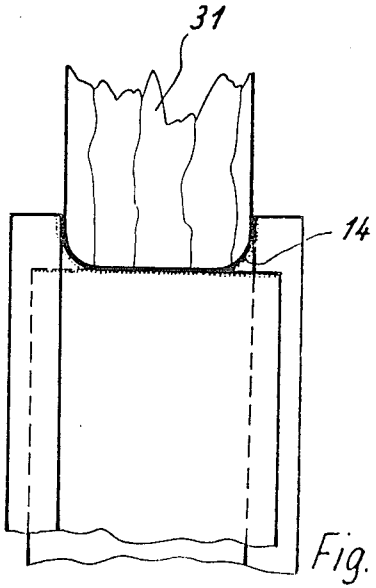
Figure 15:
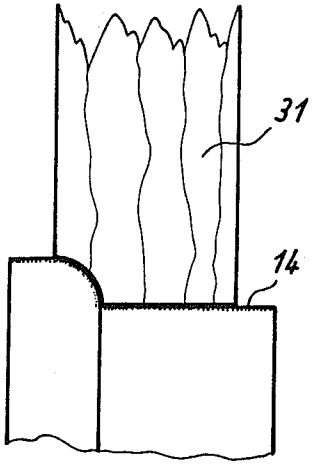
Figure 16:
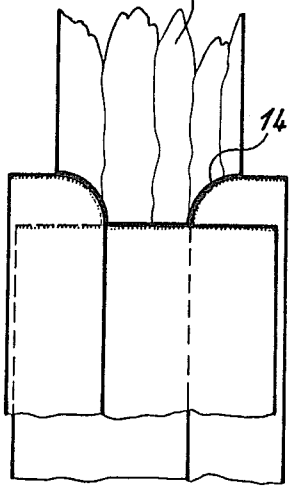
Figure 18:
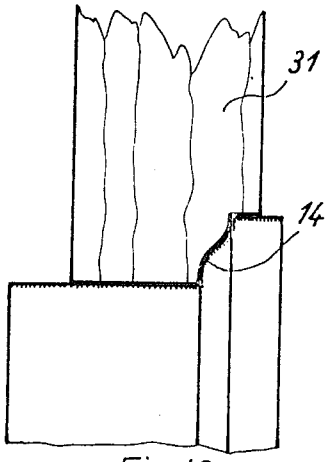
Figure 17:
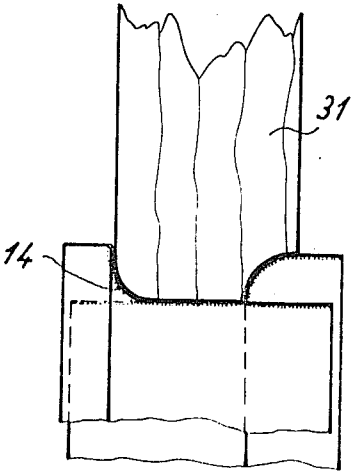
Figure 19:
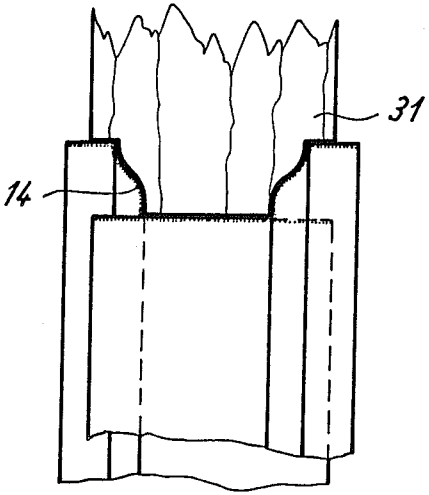
Figure 20:
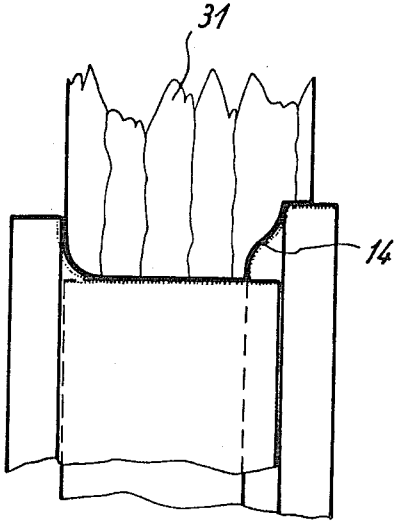

FIGS. 13–20 show some examples of use of the inventive grinding tool. The respective strip to be ground is identified with reference numeral 31. The strip of FIG. 13 is rounded on one longitudinal edge. For this case the tool shown in FIG. 3 is suitable, for example. The strip of FIG. 14 is provided with a radius on two opposite longitudinal edges. The tool of FIG. 4 is suitable for this. For adjusting to a different width, only the spacer ring 25 need be replaced. The strips of FIGS. 15 and 16 are provided with a groove in one or two opposite longitudinal edges. Both embodiments can be worked with the same grinding segment. A combination of the strips of FIGS. 13 and 15 is shown in FIG. 17. For grinding a rounding on one side and a groove on the other side, no special segments are needed, since there is a possibility of using different grinding segments which are used for working the strips of FIGS. 13 or 15. From a comparative consideration of the above described profiles, it can be seen that it is possible to work five profiles with the grinding segments of only two shapes. In the strip of FIG. 18 a curved rear driving surface is ground. The same shape is made in the strip of FIG. 19 on two opposite longitudinal edges. Here also the grinding segments of only one shape are needed. In the strip of FIG. 20 a radius of FIG. 13 is ground on one side and the shape of FIG. 18 is ground on the opposite side. For this shape also no new grinding segments need to be produced. In the above-presented examples eight different profile strips are shown. For these examples the grinding segments of only three different shapes are required. Since for an extremely great number of the known profile strips the grinding segments of different shapes are considerably reduced, the grinding segments can be produced in a substantially cost-favorable manner since the number of the tools required for manufacture of the grinding segments is also reduced. Furthermore, the remaining shapes are produced in a great number of pieces and thereby also in a cost-favorable manner. The invention is not limited to the details shown, since various modifications and structural changes are possible without departing in any way from the spirit of the present invention. What is desired to be protected by Letters Patent is set forth in particular in the appended claims.

We claim:

1. A grinding tool for profile strips of wood or the like, comprising a plurality of grinding segments arranged in at least two rows;

at least two base bodies, each associated with one of said rows of said grinding elements, said base bodies being movable relative to one another, said grinding segments of one of said rows being offset relative to said grinding segments of the other of said rows so that said rows of said grinding segments are insertable into one another over at least a part of a respective length thereof;

a plurality of grinding segment receivers mounted on said base bodies;

a plurality of supporting segments, each carrying one of said grinding segments, each of said supporting segments being releasably mountable on a respective one of said grinding segment receivers so that each of said grinding segments carried thereby is fixable on a respective one of said grinding segment receivers in two respective mirror-inverted operative positions; and clamping means including two clamping elements associated with and located at each side of a respective one of said base bodies so as to engage said grinding segments, said two clamping elements including an inner clamping element which is basket-shaped and has a plurality of webs which are spaced from one another by respective angular distances and lie under said grinding segment receivers, and another clamping element which has a plurality of intermediate spaces into which said webs of said inner basket-shaped clamping element are insertable.

2. A grinding tool as defined in claim 1, wherein each of said base bodies has an axis, said base bodies being movable relative to one another in an axial direction.

3. A grinding tool as defined in claim 1, wherein said base bodies are movable relative to one another in a common plane.

4. A grinding tool as defined in claim 1, wherein each of said grinding segments is provided with a grinding coating.

5. A grinding tool as defined in claim 1, wherein said supporting segments are formed in correspondence with a surface to be ground.

6. A grinding tool as defined in claim 1, wherein each of said grinding segments is fitted over a respective one of said supporting segments.

7. A grinding tool as defined in claim 1, wherein said grinding segment receivers have a predetermined width, said grinding segment receivers being arranged so that a distance between two grinding segment receivers of one of said rows is at most equal to the width of one of said grinding segment receivers.

8. A grinding tool as defined in claim 1, wherein said base bodies have at least similar constructions.

9. A grinding tool as defined in claim 1, wherein said base bodies and said grinding segment receivers are of one piece with each other.

10. A grinding tool as defined in claim 1, wherein each of said supporting segments includes a supporting part and a base profile segment mounted on said supporting part, said base profile segment corresponding to a contour of a surface to be ground and being composed of an elastic material.

11. A grinding tool as defined in claim 10, wherein said supporting part of said supporting segment is formed as a shaped part.

12. A grinding tool as defined in claim 10, wherein said supporting part of said supporting segment is formed as a profiled strip.

13. A grinding tool as defined in claim 1, wherein said base bodies are disc-shaped and have outer edges provided with a plurality of such grinding segment receivers, which latter extend normal to a plane of said disc-shaped bodies and are arranged at respective equal angular distances from one another.

14. A grinding tool as defined in claim 13, wherein each of said bodies is provided with five of said grinding segment receivers arranged at said equal respective angular distances from one another.

15. A grinding tool as defined in claim 13, wherein each of said grinding segments has end faces provided with projections, clamping elements engaging said projections of said end faces of said grinding segments.

16. A grinding tool as defined in claim 15, wherein said clamping elements are disc-shaped, said clamping elements associated with a respective one of said base bodies having outer edges which are angled in a direction to said end faces of said grinding segments and provided with recesses located between respective of said grinding segments.

17. A grinding tool as defined in claim 15, wherein said clamping elements have outer edges, said inner clamping element which is basket-shaped and having an outer edge provided with said webs which extend normal to a plane of said inner clamping element and correspond to a number of said grinding segment receivers, said webs being spaced from one another by equal respective angular distances.

18. A grinding tool as defined in claim 15; and further comprising a spacer ring which is located between said clamping elements and has a length which determines a width of the grinding tool.

19. A grinding tool as defined in claim 15, wherein said clamping elements which are associated with a respective one of said bodies have angled edges which are symmetrical relative to one another.

20. A grinding tool as defined in claim 1, wherein said supporting segments are formed in correspondence with a surface to be ground, said base bodies and said grinding segments being axially movable relative to each other, each of said supporting segments including a supporting part and a base profile segment mounted on said supporting part and composed of an elastic material.

21. A grinding tool as defined in claim 1, wherein each of said supporting segments has a web; and further comprising a plurality of grinding segment receivers, each having a longitudinal slot which extends in direction of an axis of rotation of the grinding tool and receives said webs of said supporting segment.

22. A grinding tool as defined in claim 21, wherein each of said supporting segments has a profile strip provided with said web which is engageable in said longitudinal slot.

23. A grinding tool for profile strips of wood or the like, comprising a plurality of grinding segments arranged in at least two rows and having end faces provided with projections;

at least two base bodies which are disc-shaped and have outer edges, each of said base bodies being associated with one of said rows of said grinding segments, said base bodies being movable relative to one another, said grinding segments of one of said rows being offset relative to said grinding segments of the other of said rows so that said rows of said grinding segments are insertable into one another over at least a part of a respective length thereof;

a plurality of grinding segment receivers mounted on said outer edges of said base bodies and extending normal to a plane of said disc-shaped bodies at respective equal angular distances from one another;

a plurality of supporting segments, each carrying one of said grinding segments, each of said supporting segments being releasably mountable on a respective one of said grinding segment receivers so that each of said supporting segments with a respective one of said grinding segments carried thereby is fixable on a respective one of said grinding segment receivers in two respective mirror-inverted operative positions; and clamping means including two clamping elements associated with each of said base bodies and engaging said projections of said end faces of said grinding segments, said clamping elements having outer edges and being located at each side of a respective one of said base bodies, said clamping elements including an inner clamping element which is basket-shaped and has an outer edge provided with webs which extend normal to a plane of said inner clamping element and correspond to a number of said grinding segment receivers, said webs being spaced from one another by equal respective angular distances and lying under said grinding segment receivers.

24. A grinding tool as defined in claim 23, wherein said clamping elements which are arranged at each side of a respective one of said base bodies include another clamping element which has intermediate spaces, said webs of said basket-like inner clamping element being insertable into said intermediate spaces of said other clamping element.

* * * * *

UNITED STATES PATENT AND TRADEMARK OFFICE

CERTIFICATE OF CORRECTION

PATENT NO. : 4,777,771

DATED : October, 18, 1988

INVENTOR(S) : Paul Becker et al

It is certified that error appears in the above—identified patent and that said Letters Patent is hereby corrected as shown below:

In the Heading, correct the filing date to read:

-- February 17, 1987 --

Signed and Sealed this

Eighteenth Day of April, 1989

*Attest:*

DONALD J. QUIGG

*Attesting Officer*

*Commissioner of Patents and Trademarks*